US005514329A

United States Patent [19]

McCaul et al.

[11] Patent Number: 5,514,329

[45] Date of Patent: May 7, 1996

[54] CAVITATION RESISTANT FLUID IMPELLERS AND METHOD FOR MAKING SAME

[75] Inventors: Colin McCaul, Chatham, N.J.; Vincenzo Fumagalli, Milan, Italy

[73] Assignee: Ingersoll-Dresser Pump Company, Liberty Corner, N.J.

[21] Appl. No.: 266,278

[22] Filed: Jun. 27, 1994

[51] Int. Cl.[6] ..... C22C 38/58; C21D 6/00

[52] U.S. Cl. ..... 420/56; 148/327; 148/607

[58] Field of Search ..... 420/56, 74; 148/32, 148/607

[56] References Cited

U.S. PATENT DOCUMENTS

| | | | |
|---|---|---|---|
| Re. 24,431 | 2/1958 | Jennings | 75/126 |
| 2,198,598 | 4/1940 | Becket et al. | 75/126 |
| 3,151,979 | 10/1964 | Carney et al. | 75/128 |
| 3,171,738 | 3/1965 | Renshaw et al. | 75/128 |
| 3,366,472 | 1/1968 | Tanczyn et al. | 75/128 |
| 3,554,736 | 1/1971 | Kusaka et al. | 75/128 |
| 3,904,401 | 9/1975 | Mertz et al. | 75/125 |
| 4,326,885 | 4/1982 | Larson et al. | 75/125 |
| 4,405,389 | 9/1983 | Larson | 148/37 |
| 4,450,008 | 5/1984 | Andreini et al. | 75/128 A |
| 4,481,033 | 11/1984 | Fujiwara et al. | 75/128 A |
| 4,588,440 | 5/1986 | Simoneau | 75/126 B |
| 4,675,156 | 6/1987 | Sakamoto et al. | 420/34 |
| 4,721,600 | 1/1988 | Maehara et al. | 420/57 |
| 4,751,046 | 6/1988 | Simoneau | 420/36 |
| 4,814,140 | 3/1989 | Magee, Jr. | 420/56 |
| 4,851,059 | 7/1989 | Sumitomo et al. | 148/327 |
| 4,957,700 | 9/1990 | Honkura et al. | 420/74 |

FOREIGN PATENT DOCUMENTS

| | | |
|---|---|---|
| 1314540 | 12/1962 | France . |
| 57-152447 | 9/1982 | Japan . |

OTHER PUBLICATIONS

Cerpadal Potrubi Armatury, Nos. 2–3, pp. 28–34, 1989, Stephan Urbanec, "Properties of Developmental Metastable Austenitic Steels for Castings–Resistance to Cavitation Wear".

ASM Conference–Coatings & Bi–Metallics for Agressive Enviroments, Nov. 1984, Akhtar et al., "Cavitation Erosion of Stainless Steel, Nickel and Colbalt Alloy Weld Overlay Materials".

Corrosion Engineering, vol. 36, No. 2, 1987, pp. 81–89 Ozaki et al., "Development of Cavitation Erosion Resistant Stainless Steel for Use in Sea Water Hydraulic Machines".

Metalurgical Transactions, vol. 3, May 1972, pp. 1137–1145, D. A, Woodford, "Cavitation–Erosion–Induced Phase Transformations in Alloys" .

Conference on High Manganese Steels, Oct. 1987, pp. 119–126 Bal Raj Nijhawan, "Substitute Nickel–Free Chromium, Manganese, Nitrogen Austenitic Stainless Steels".

IAHR Symposium, 1986, Raynald Simoneau, "A New Class of High Strain–Hardening Austenitic Steels to Fight Cavitation Erosion".

Advances in Technology of Stainless Steels, 1965, pp. 54–61 J. J. Heger, "Mechanical Properties and Corrosion Resistance of A High–Strength Chromium–Manganese–Nitrogen–Stainless Steel".

*Primary Examiner*—Deborah Yee

*Attorney, Agent, or Firm*—Michael H. Minns; Robert F. Palermo

[57] ABSTRACT

A fluid impeller for us in applications requiring superior cavitation erosion resistance. The impeller has a body fabricated from a castable metastable austenitic steel alloy which has a preferred chemical composition in the range of 17.5–18.5% chromium, 0.5–0.75% nickel, 0.45–55% silicon, 0.2–0.25% nitrogen, 15.5–16.0% manganese and 0.1%–0.12% carbon. Quantitative testing has shown cavitation resistance of four to six times that of standard boiler feed pump materials. A method for making cavitation resistant fluid impellers is also disclosed.

14 Claims, 2 Drawing Sheets

CAVITATION RESISTANT FLUID IMPELLERS AND METHOD FOR MAKING SAME

BACKGROUND OF THE INVENTION

This invention relates generally to fluid impellers and more particularly to cavitation resistant fluid impellers made from castable cavitation resistant austenitic chromium-manganese alloy steels.

Pump impellers frequently suffer cavitation damage for several reasons, including operation outside established hydraulic parameters. This damage is often a limiting factor in the life of the equipment. It may not be repairable by welding for reasons of inaccessibility. With a growing emphasis on enhanced reliability and longer life, there is a need in the pump industry for a casting alloy with significantly better cavitation resistance than the standard materials used to manufacture impellers. Other characteristics required for such a material to be commercially viable include machinability and weldability.

For high speed applications, relatively high tensile and yield strength, and elongation will also be necessary. The mechanical properties of commonly used austenitic stainless steels, such as CF8M are: tensile strength 482 N/mm$^2$ and yield strength 208 N/mm$^2$ minimum. These low mechanical properties render such materials unsuitable for high speed impellers.

The current state-of-the-art cavitation resistant material which has been used in pumps is a cobalt modified austenitic stainless steel known as Hydroloy®. Hydroloy® is described in U.S. Pat. No. 4,588,440, Co Containing Austenitic Stainless Steel with High Cavitation Erosion Resistance. One deficiency of Hydroloy® is susceptibility to hot short cracking. This characteristic contributes to poor castability. The presence of cobalt is also undesirable for some applications, particularly the nuclear industry.

The foregoing illustrates limitations known to exist in present cavitation resistant alloy steels. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid impeller for use in applications requiring a high degree of cavitation erosion resistance, the impeller having a body fabricated from a castable metastable austenitic steel alloy which has a chemical composition in the following range:

| | C | Mn | N | Si | Ni | Cr |
|---|---|---|---|---|---|---|
| % min | 0.08 | 14.0 | | 0.3 | | 17.0 |
| % max | 0.12 | 16.0 | 0.45 | 1.0 | 1.0 | 18.5 |

the balance comprising iron and impurities.

The foregoing and other aspects will become apparent from the following detailed description of the invention when considered in conjunction with the accompanying drawing figure.

DETAILED DESCRIPTION

Figure 1:
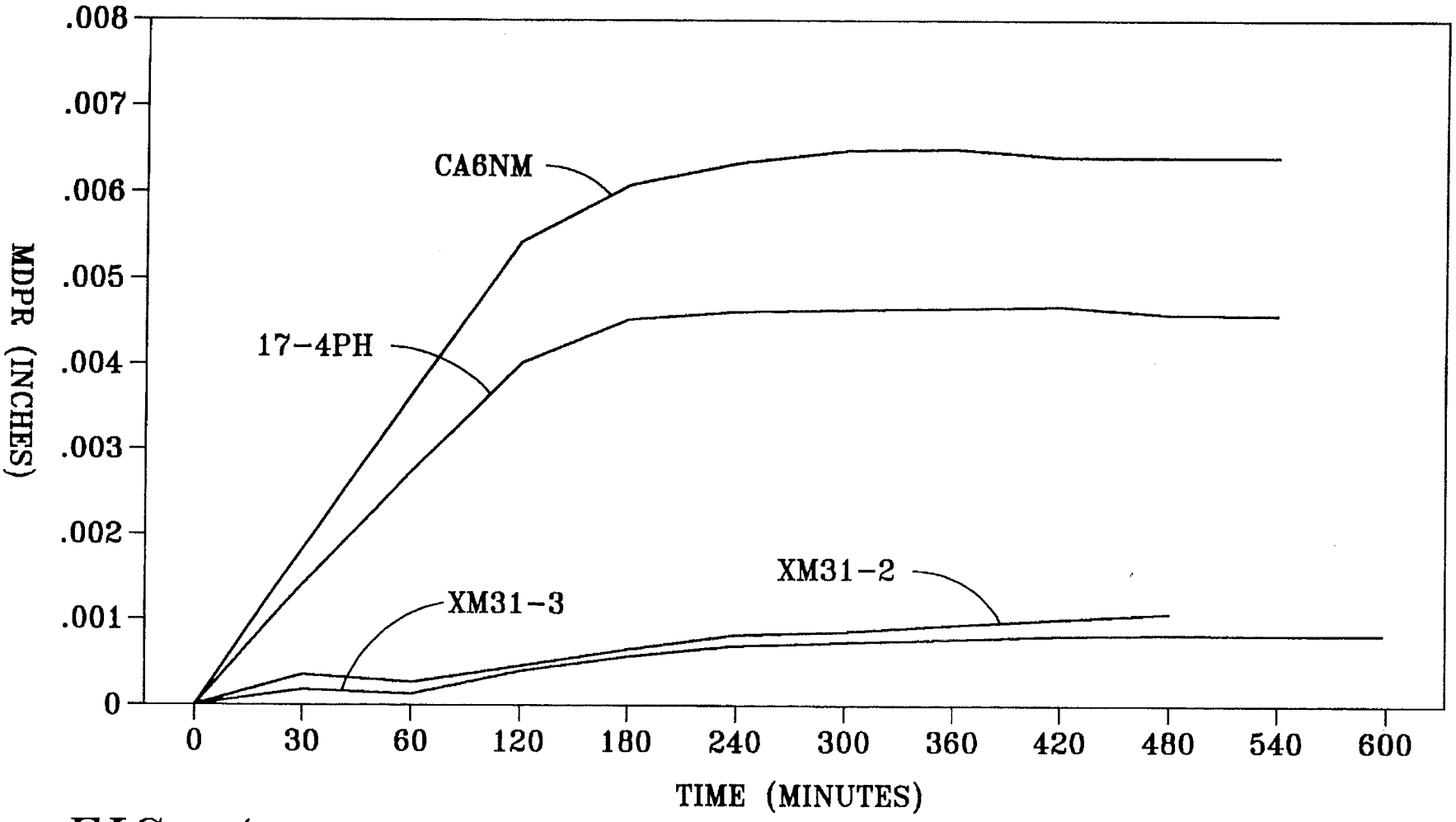
FIG. 1 is a graph showing the cavitation damage versus time for the alloy of the present invention (known as XM31) and two conventional stainless casting alloys.

The alloy described below has demonstrated cavitation resistance several times better than that of existing standard impeller materials. This new alloy also satisfies not desirable criteria, including castability, weldability, machinability, and low cost.

This steel belongs to a class of alloys known as metastable austenitic steels. Both stainless and nonstainless grades of metastable austenitic steels have been produced. Austenite in metastable alloys can transform spontaneously into martensite either on cooling or as a result of deformation. This alloy has an austenitic structure upon water quenching from the solution annealing temperature but will transform to martensite on exposure to impact loading. The transformation which occurs in this class of materials is accompanied by an increase in hardness and has been exploited commercially in steels for wear and abrasion resistant applications. Hadfield manganese steels (a nonstainless type) are the best known of this class.

The ease with which metastable alloys can be induced to transform to martensite is related to a characteristic known as stacking fault energy. Chemical composition can be adjusted to produce an alloy with low stacking fault energy which will readily develop fine cavitation induced twinning associated with the formation of a martensitic phase. The fine twinning is an efficient means of absorbing the incident cavitation impact energy. The relationship between low stacking fault energy and high resistance to cavitation was first identified by D. A. Woodward, Cavitation-Erosion-Induced Phase Transformations in Alloys, Metallurgical Transactions, Volume 3, May 1972.

In this class of materials, the element nickel is known to promote a stable austenitic structure, whereas both manganese and nitrogen tend to promote the transformation of austenite to martensite. However, nitrogen has a tendency to cause bubbling during solidification.

An old alloy, Tenelon, produced by United States Steel, has a composition:

| | C | Mn | N | Si | Ni | Cr |
|---|---|---|---|---|---|---|
| % min | 0.08 | 14.5 | 0.35 | 0.30 | | 17.0 |
| % max | 0.12 | 16.0 | | 1.0 | 0.75 | 18.5 |

Tenelon is a wrought steel, not previously produced in cast form. Experimental efforts to develop a cast version of Tenelon have not been acceptable due to excessive porosity.

The cavitation-resistant alloy (designated, generally "XM-31") according to this invention contains 17.5–18.5% chromium, 0.5–0.75% nickel, 0.45– 0.55% silicon, 0.2–0.25% nitrogen, 15.5–16.0% manganese and 0.1%–0.12% carbon, the balance being iron and impurities. Preferably, phosphorus and sulfur are less than 0.02%. After the alloy is cast, the article is heat treated at 1050° C. to 1100° C. for one hour per inch of thickness, followed by a water quench.

The preferred range of chemistry for the new alloy is:

| | C | Mn | N | Si | Ni | Cr |
|---|---|---|---|---|---|---|
| % min | 0.08 | 15.0 | 0.10 | 0.4 | | 17.0 |
| % max | 0.12 | 16.0 | 0.30 | 0.8 | 1.0 | 18.5 |

The alloy has a specific composition of critical elements as follows:

| | C | Mn | N | Si | Ni | Cr |
|---|---|---|---|---|---|---|
| % min | 0.10 | 15.5 | 0.20 | 0.45 | 0.5 | 17.5 |
| % max | 0.12 | 16.0 | 0.25 | 0.55 | 0.75 | 18.5 |

Figure 2:
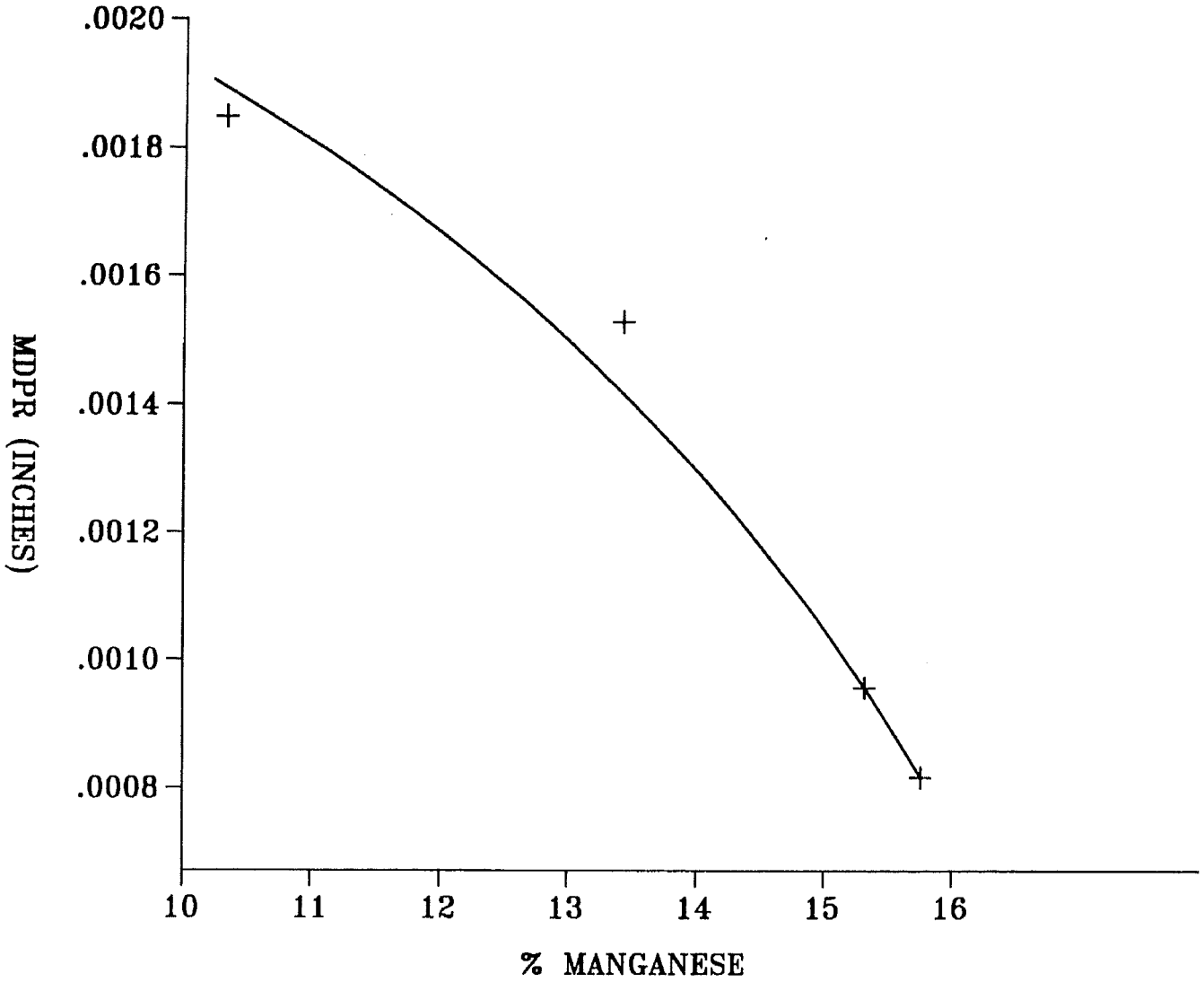
FIG. 2 is a graph showing the relationship between the cavitation damage and manganese content.

We have determined that the manganese content is important to cavitation resistance. FIG. 2 shows the relationship between manganese and cavitation resistance. Preferably, the manganese content content is 16%.

When casting articles using this new alloy, we have determined that olivine sand [$(MgFe)_2SiO_4$] should be used for the molds. The metal bath should be kept at 1500° C. to limit oxidation. Manganese in steel reduces solubility for nitrogen. Excess nitrogen in high manganese steel, which exceeds the solubility limit, promotes bubbling and gas defects as the casting solidifies. Consequently, nitrogen should be added to the melt just prior to casting.

Quantitative laboratory cavitation test data was developed in accordance with ASTM G32-92 for several heats of the new alloy. Cavitation resistance was consistently superior, by a factor of about six, compared with the martensitic stainless alloy CA6NM which is the industry standard in boiler feed pumps and other demanding impeller applications where cavitation is a chronic problem. Cavitation resistance of the new material also exceeds by a factor of about four, that of 17-4PH and CA15Cu, both utilized in the pump industry as upgrades for CA6NM. The new alloy combines high mechanical properties, adequate for high energy pumps, with a level of cavitation resistance which far exceeds that of conventional materials.

Table I and FIG. 1 summarize the results of cavitation tests carried out by the inventors. The table presents a comparison of the Brinell Hardness Number (BHN) and the Mean Depth of Penetration Rate (MDPR) for several alloys during cavitation testing. The composition of test sample XM31-2 is: carbon 0.11%, manganese 15.3%, silicon 0.49% and chromium 18.39% and test sample XM31-3 is: carbon 0.11%, manganese 15.7%, silicon 0.51% and chromium 17.17%.

CAVITATION TEST RESULT SUMMARY

| Material | BHN | MDPR |
|---|---|---|
| XM31-3 | 260 | 0.00089 |
| Cast CA15Cu | 388 | 0.00400 |
| 17-4PH(cond. H1150) | 255 | 0.00469 |
| Cast CA6NM(Dresser) | 262 | 0.00651 |
| Cast CA6NM | 262 | 0.00740 |
| Cast CA15 | 217 | 0.01110 |

The mechanical properties of the new alloy are: tensile strength 676–745 N/mm$^2$ yield strength 410–480 N/mm$^2$ and elongation 43.2–53.7%. These properties are based upon testing of five different XM31 samples. It has also been determined that the new alloy can be welded using commercially available filler metals, and machined using standard techniques employed in the manufacture of pump impellers.

The resulting alloy, described above, offers cavitation resistance far superior to that of conventional stainless casting alloys. It develops this high resistance by a strain hardening mechanism associated with the formation of cavitation induced twinning. This significantly delays the initiation of fatigue cracking.

In the following claims, a blank means no minimum of the alloying agent specified.

Having described the invention, what is claimed is:

1. A fluid impeller for use in applications requiring a high degree of cavitation erosion resistance, said impeller comprising:

a body cast from a castable metastable austenitic steel alloy, said alloy having a chemical composition in the following range:

| | C | Mn | N | Si | Ni | Cr |
|---|---|---|---|---|---|---|
| % min | 0.08 | 14.0 | | 0.3 | | 17.0 |
| % max | 0.12 | 16.0 | 0.45 | 1.0 | 1.0 | 18.5 |

the balance comprising iron and impurities.

2. The fluid impeller for use in applications requiring a high degree of cavitation erosion resistance, according to claim 1, further comprising:

said body having been subjected to a heat treatment including a solution anneal at 1050° C. to 1100° C. for one hour per inch of thickness followed by a water quench.

3. A fluid impeller for use in applications requiring a high degree of cavitation erosion resistance, said impeller comprising:

a body fabricated from a castable metastable austenitic steel alloy, said alloy having a chemical composition in the following range:

| | C | Mn | N | Si | Ni | Cr |
|---|---|---|---|---|---|---|
| % min | 0.08 | 15.0 | 0.10 | 0.4 | | 17.0 |
| % max | 0.12 | 16.0 | 0.30 | 0.8 | 1.0 | 18.5 |

the balance comprising iron and impurities.

4. A fluid impeller according to claim 3, having been heat treated as follows:

solution anneal at 1050° C. to 1100° C. for one hour per inch of thickness followed by a water quench.

5. A fluid impeller for use in applications requiring a high degree of cavitation erosion resistance, said impeller comprising:

a body fabricated from a castable metastable austenitic steel alloy, said alloy having a chemical composition in the following range:

| | C | Mn | N | Si | Ni | Cr |
|---|---|---|---|---|---|---|
| % min | 0.10 | 15.5 | 0.20 | 0.45 | 0.5 | 17.5 |
| % max | 0.12 | 16.0 | 0.25 | 0.55 | 0.75 | 18.5 |

the balance comprising iron and impurities.

6. A fluid impeller according to claim 5, having been heat treated as follows:

solution anneal at 1050° C. to 1100° C. for one hour per inch of thickness followed by a water quench.

7. A fluid impeller according to claim 5, wherein the manganese content in said castable metastable austenitic steel alloy is 16%.

8. A method for making a fluid impeller having a high degree of cavitation resistance, comprising the following steps:

selecting a castable metastable austenitic steel alloy from alloys having the following range of chemical compositions:

| | C | Mn | N | Si | Ni | Cr |
|---|---|---|---|---|---|---|
| % min | 0.08 | 14.0 | | 0.3 | | 17.0 |
| % max | 0.12 | 16.0 | 0.45 | 1.0 | 1.0 | 18.5 |

the balance comprising iron and impurities;

fabricating said fluid impeller from said castable metastable austenitic steel alloy; and heat treating said fluid impeller by solution treating at 1050° C. to 1100° C. for one hour per inch of thickness followed by a water quench.

9. The method for making a fluid impeller having a high degree of cavitation resistance, according to claim 8, wherein the castable metastable austenitic steel alloy is selected from alloys having chemical compositions in the following range:

| | C | Mn | N | Si | Ni | Cr |
|---|---|---|---|---|---|---|
| % min | 0.08 | 15.0 | 0.10 | 0.4 | | 17.0 |
| % max | 0.12 | 16.0 | 0.30 | 0.8 | 1.0 | 18.5 |

the balance comprising iron and impurities.

10. The method for making a fluid impeller having a high degree of cavitation resistance, according to claim 8, wherein the castable metastable austenitic steel alloy is selected from alloys having chemical compositions in the following range:

| | C | Mn | N | Si | Ni | Cr |
|---|---|---|---|---|---|---|
| % min | 0.10 | 15.5 | 0.20 | 0.45 | 0.5 | 17.5 |
| % max | 0.12 | 16.0 | 0.25 | 0.55 | 0.75 | 18.5 |

the balance comprising iron and impurities.

11. The method for making a fluid impeller having a high degree of cavitation resistance, according to claim 8, wherein the castable metastable austenitic steel alloy is selected with a manganese content of 16%.

12. The method for making a fluid impeller having a high degree of cavitation resistance, according to claim 9, wherein the castable metastable austenitic steel alloy is selected with a manganese content of 16%.

13. The method for making a fluid impeller having a high degree of cavitation resistance, according to claim 8, wherein the fluid impeller is cast in a mold made from olivine sand [$(MgFe)_2SiO_4$].

14. The method for making a fluid impeller having a high degree of cavitation resistance, according to claim 8, wherein the fluid impeller is cast from said castable metastable austenitic steel alloy; said alloy having been melted at a temperature not greater than 1500° C.

* * * * *